US007497659B2

(12) United States Patent
Hsu et al.

(10) Patent No.: US 7,497,659 B2
(45) Date of Patent: Mar. 3, 2009

(54) HEAT-DISSIPATING DEVICE

(75) Inventors: Wei-Chun Hsu, Taoyuan (TW); Shun-Chen Chang, Taoyuan (TW); Wen-Shi Huang, Taoyuan (TW); Hsiou-Chen Chang, Taoyuan (TW)

(73) Assignee: Delta Electronics Inc., Taoyuan Hsien (TW)

( * ) Notice: Subject to any disclaimer, the term of this patent is extended or adjusted under 35 U.S.C. 154(b) by 463 days.

(21) Appl. No.: 11/150,185

(22) Filed: Jun. 13, 2005

(65) Prior Publication Data

US 2005/0260071 A1 Nov. 24, 2005

Related U.S. Application Data

(63) Continuation-in-part of application No. 10/848,074, filed on May 19, 2004, now Pat. No. 7,241,110.

(30) Foreign Application Priority Data

Jun. 18, 2004 (TW) ..... 93117622 A

(51) Int. Cl.
*F01D 11/02* (2006.01)

(52) U.S. Cl. ..... 415/183; 415/185; 415/206; 415/208.1

(58) Field of Classification Search ..... 415/173.7, 415/185, 183, 191, 203, 204, 206, 208.1, 415/208.2

See application file for complete search history.

(56) References Cited

U.S. PATENT DOCUMENTS

| | | | | |
|---|---|---|---|---|
| 2,641,442 | A * | 6/1953 | Buchi | 415/191 |
| 3,846,039 | A * | 11/1974 | Stalker | 415/206 |
| 4,483,664 | A | 11/1984 | Armbruster | |
| 5,188,508 | A | 2/1993 | Scott et al. | |
| 5,749,702 | A * | 5/1998 | Datta et al. | 415/119 |
| 5,951,245 | A * | 9/1999 | Sullivan | 415/192 |
| 5,982,064 | A | 11/1999 | Umeda et al. | |
| 6,092,988 | A * | 7/2000 | Botros | 415/191 |
| 6,179,561 | B1 | 1/2001 | Horng et al. | |

FOREIGN PATENT DOCUMENTS

| | | | |
|---|---|---|---|
| CN | 1268629 | A | 10/2000 |
| DE | 20309621 | U1 | 10/2003 |
| JP | 57-008398 | A | 1/1982 |
| JP | 59-029799 | A | 2/1984 |
| JP | 60-130144 | U | 7/1985 |
| JP | 61-006320 | A | 1/1986 |
| JP | 61-078776 | U | 4/1986 |
| JP | 5-240190 | A | 9/1993 |
| JP | 7-211961 | A | 8/1995 |
| JP | 3074771 | A | 11/2000 |
| JP | 2002-070791 | A | 3/2002 |
| JP | 2003-056498 | A | 2/2003 |

* cited by examiner

*Primary Examiner*—Igor Kershteyn
(74) *Attorney, Agent, or Firm*—Birch, Stewart, Kolasch & Birch, LLP

(57) ABSTRACT

A heat-dissipating device includes a housing having an air inlet and an air outlet, and a rotor disposed in the housing and having a first set of blades, wherein the housing has a sidewall extending inward from the air inlet to define an air-gathering chamber in the housing, and a plurality of air-guiding members disposed along the sidewall for increasing and stabilizing a blast pressure of airflow passing through the heat-dissipating device.

20 Claims, 9 Drawing Sheets

HEAT-DISSIPATING DEVICE

FIELD OF THE INVENTION

The present invention is a continuation-in-part application of the parent application bearing Ser. No. 10/848,074 and filed on May 19, 2004 now U.S. Pat No. 7,241,110. The present invention relates to a heat-dissipating device, and in particular to a centrifugal fan for increasing and stabilizing the airflow pressure.

DESCRIPTION OF THE RELATED ART

In FIG. 1, a conventional blower 1 includes a frame 10, a motor 11, an impeller 12 and a cover 13. The frame 10 includes an opening 101 as an air outlet and the cover 13 has a circular opening 131 as an air inlet. The way from the air inlet to the air outlet constitutes an airflow passage. The motor 11 is disposed on a base 102 of the frame 10 to drive the impeller 12. The impeller 12 includes a hub 121, an annular plate 122, and a plurality of blades 123 disposed on the upper side and the lower side of the annular plate 122 and circumferentially disposed around the hub 121.

However, because the air directly flows toward the blades and there is a large gap between the upper-side blade and the lower-side blade, the airflow rate is suddenly increased to induce a high load of the blades and decrease the rotation speed, and it is hard to control the air flow direction, resulting in causing the reverse airflow and reducing the heat-dissipating performance.

Moreover, some conventional blowers have a plurality of ribs positioned on the air inlet or outlet to strengthen the structure of the blower. However, the ribs can not provide the air-guiding function or prevent the reverse airflow, and become an obstructor in the airflow field of the blower. Therefore, it is helpless to enhance the heat-dissipating performance.

SUMMARY OF THE INVENTION

According to the present invention, the heat-dissipating device includes a housing having at least one opening, and a rotor disposed in the housing and having a first set of blades, wherein the housing has a sidewall extending from the opening, and a plurality of air-guiding members disposed along the sidewall for increasing a blast pressure of airflow passing through the heat-dissipating device.

The housing further includes a first frame provided with a base for supporting the rotor, and a second frame coupled to the first frame and provided with the opening, wherein the sidewall extends from a periphery of the opening inwardly to define an air-gathering chamber in the housing.

The sidewall has a flange at one end thereof extending radially to define an entrance of the air-gathering chamber and each of the blades has an end extending toward the entrance of the air-gathering chamber for guiding the airflow into the air-gathering chamber. The air-gathering chamber partially or completely overlaps an air passage through the rotor in height along an axis of the heat-dissipating device.

In addition, the second frame has an extending part formed in an inner surface thereof and extending inwardly to form an axially compressed airflow passage in the housing.

Preferably, the second frame has a support and the plurality of air-guiding members are arranged between the sidewall and the support.

Preferably, the base of the first frame has a bearing tube formed on the base for allowing a bearing to be disposed therein and the support of the second frame receives an another bearing to support a shaft of the rotor together.

Further, the rotor further includes a hub and a base for allowing the blades extending downward from an outer periphery of the hub to a surface of the base.

Preferably, the rotor further includes a second set of blades disposed on the surface of the base and the first and second sets of blades are alternately arranged.

Preferably, a first set of the plurality of air-guiding members is connected between the sidewall and the support and a second set of the plurality of air-guiding members has opposite ends respectively connected to the sidewall and the support, and a discontinuous structure to form free ends, wherein the first and second sets of the plurality of air-guiding members are alternately arranged.

Alternatively, a first set of the plurality of air-guiding members is connected between the sidewall and the support, a second set of the plurality of air-guiding members has one end connected to the sidewall and a free end, and a third set of the plurality of air-guiding members has one end connected to the support and a free end, wherein the first, second and third sets of the plurality of air-guiding members are alternately arranged.

Preferably, the plurality of air-guiding members are shaped as strip, plate, curved, inclined or airfoil structures.

Moreover, the heat-dissipating device further includes another set of air-guiding members mounted on an another opening for discharging or intaking the airflow.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

Figure 2A:
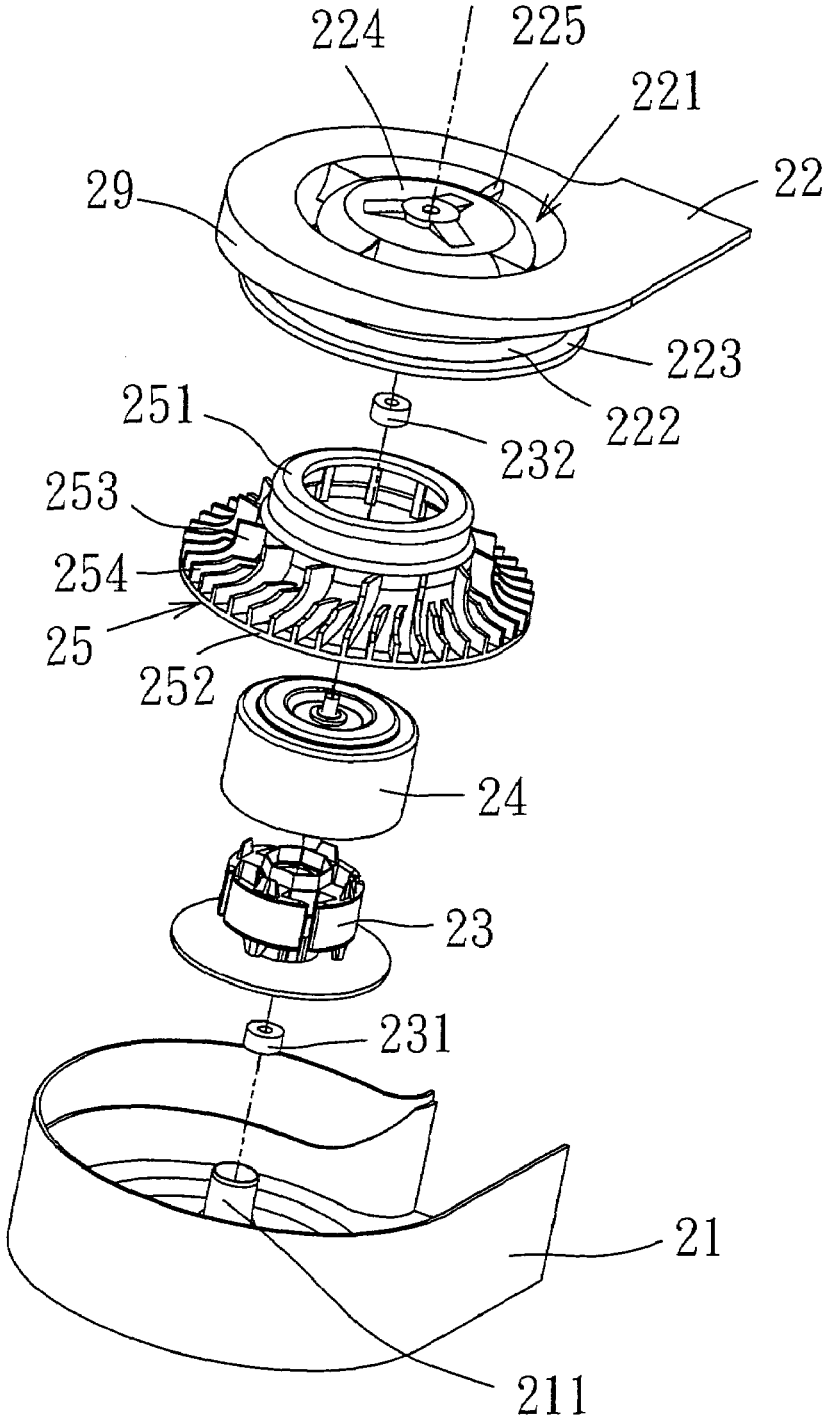
FIG. 2A is an exploded view of a heat-dissipating device according to an embodiment of the present invention.
Figure 2B:
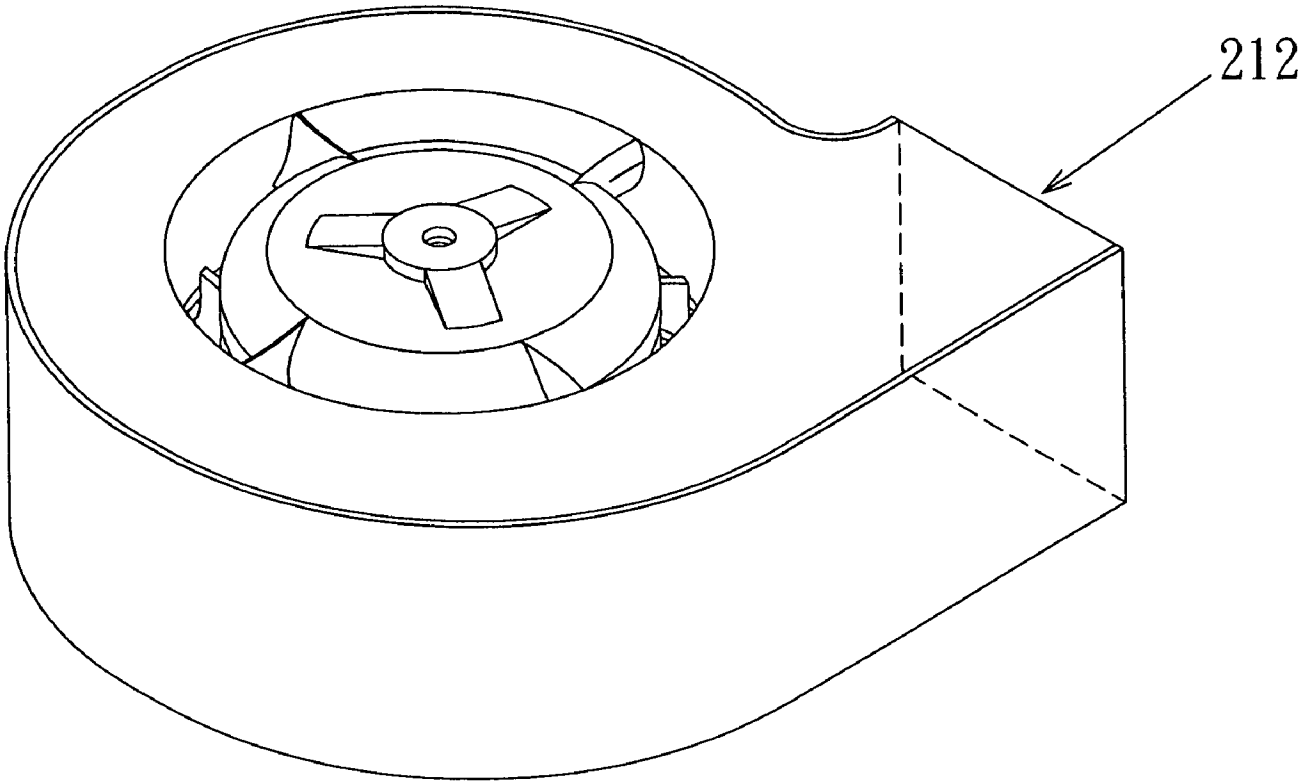
FIG. 2B is a perspective view of a heat-dissipating device of FIG. 2A after being assembled.
Figure 2C:
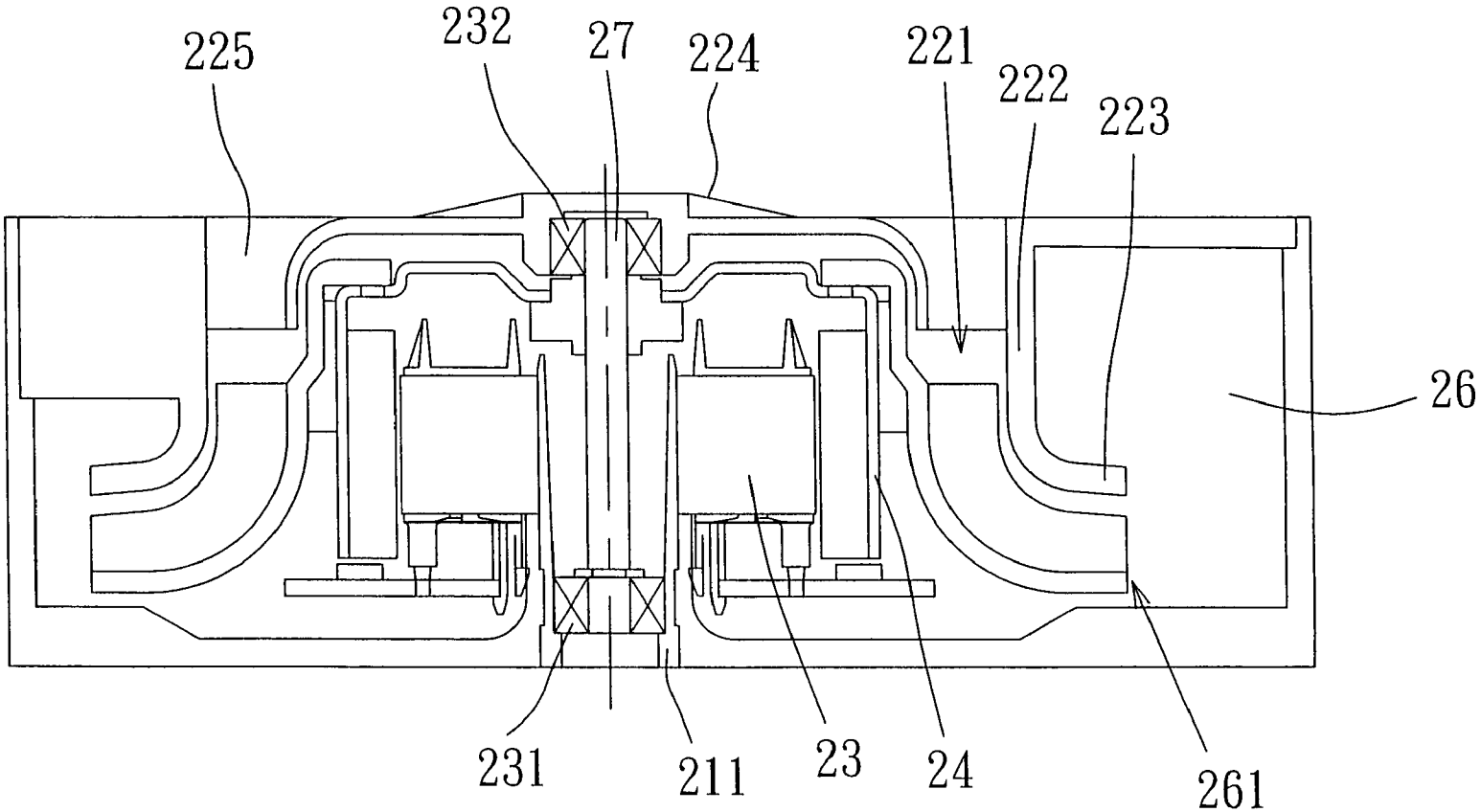
FIG. 2C is a sectional view of the heat-dissipating device of FIG. 2A after being assembled.

Please refer to FIGS. 2A~2C showing the first embodiment of the heat-dissipating device of the present invention. The heat-dissipating device is exemplified by a centrifugal fan, which is a single-suction blower. The design way of the present invention can also be applied to the axial-flow fan. The heat-dissipating device includes a housing constituted by a first frame 21 and a second frame 22, a driving device 23, a metallic shell 24 and a rotor 25.

The first frame 21 includes a base with a bearing tube 211 for receiving and supporting the driving device 23 and the bearings 231 is mounted inside the bearing tube 211 for supporting a rotating shaft 27 of the rotor 25. The second frame 22 includes an air inlet 221 and a sidewall 222 extending downward from an inner margin of the air inlet 221. When the first frame 21 and the second frame 22 are assembled together, a space will be formed inside the heat-dissipating device and can be divided to an air-gathering chamber 26 and a partition for disposing the rotor 25 therein by the sidewall 222. An air outlet 212 is also formed simultaneously as shown in FIG. 2B. A flange 223 is radially extending from the bottom of the sidewall 222 to define an entrance 261 of the air-gathering chamber 26.

The rotor 25 includes a hub 251, a base 252 radially extending from the bottom end of the hub 251, a first set of blades 253 and a second set of blades 254, and is driven by the driving device 23 coupled inside the hub 251. The first and second sets of blades 253, 254 are curved blades disposed on the base 252, respectively, and each blade has one end extending toward the entrance 261 of the air-gathering chamber 26, wherein the first set of blades is extended downward from the outer periphery of the hub 251 to the surface of the base 252. The first and second sets of blades are alternately arranged as shown in FIG. 2A. Certainly, the size, shape, and arrangement of the blades include but not limited to those shown in FIG. 2A, for example, the first and second sets of blades are up-and-down arranged. The hub 251, the base 252 and the blades 253, 254 can be integrally formed as a monolithic piece by injection molding.

The second frame 22 further has a support 224 mounted on the air inlet and a plurality of air-guiding elements 225 are disposed between the support 224 and the sidewall 222 for increasing the blast pressure of the heat-dissipating device.

As the rotor 25 rotates, the airflow is intaked into the air inlet 221, passes through the air-guiding elements 225 and the blades 253, 254, and is guided into the air-gathering chamber 26 via the entrance 261. In the air-gathering chamber 26, the airflow is gradually collected and discharged therefrom to the exterior at a high pressure via the air outlet 221, which can prevent the sudden change of the airflow pressure. Thus, the airflow sequentially passes through the air inlet 221, the air-guiding elements 225, the blades 253, 254 and the entrance 261 of the air-gathering chamber 26.

Because the sidewall 222 extends downward from the inner margin of the air inlet 221 and separates the air-gathering chamber 26 from the rotor 25 and the size of the air outlet 212 is reduced, time of airflow pressurization by the rotor 25 is increased such that the variation in airflow pressure are stabilized. Further, because the height of the air-gathering chamber 26 partially or completely overlaps that of the flow passage through the rotor 25 and the air-guiding member 225 in the axial direction, the occupied space of the centrifugal fan can be minimized. The cross-sectional area of the air-gathering chamber 26 is substantially equal in size to that of the air outlet 212 such that airflow can constantly and stably moves within the air-gathering chamber 26 and the air outlet 212 to prevent work loss.

On the other hand, the present invention adopts a two-side motor fixed design, as shown in FIG. 2C, the bearing 231 is mounted inside the bearing tube 211 and the other bearing 232 is mounted inside the support 224 of the second frame 22 for supporting the shaft 27 of the rotor 25 together so as to provide the stabilization of the centrifugal fan under the high-speed operation and eliminate the vibration.

In addition, the second frame has an extending part 29 formed in an inner side thereof and axially extending toward the first frame to form an axially compressed airflow passage in the housing as shown in FIG. 2A.

Figure 3A:
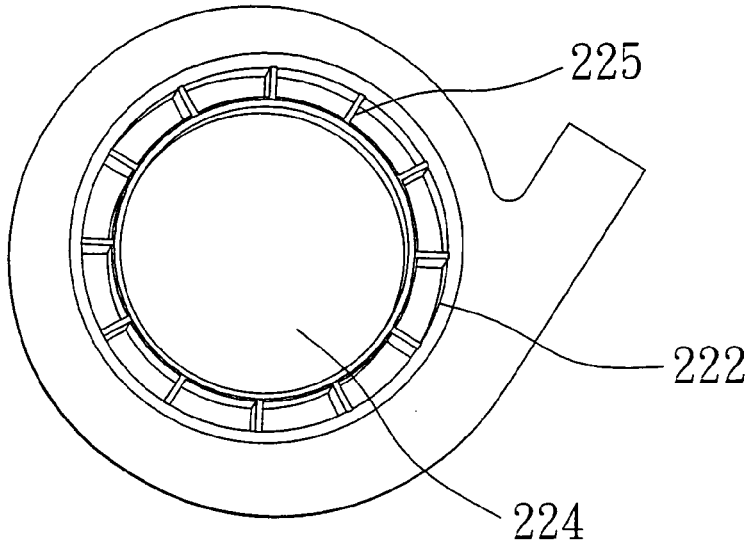
FIGS. 3A~3D are the top views of a variety of air-guiding elements in the present invention.
Figure 3B:
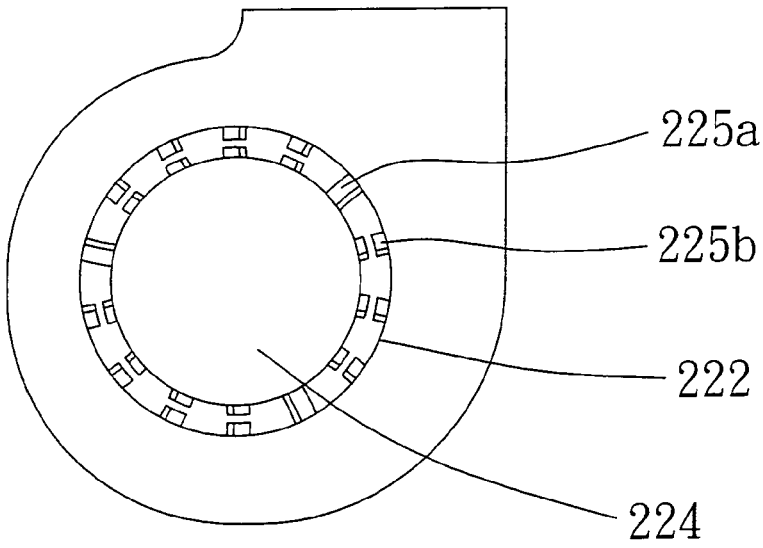
Figure 3C:
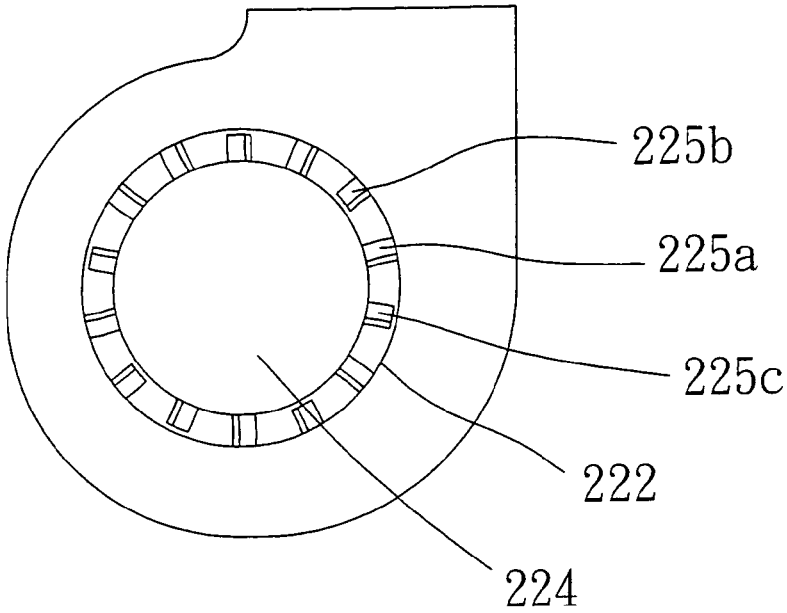
Figure 3D:
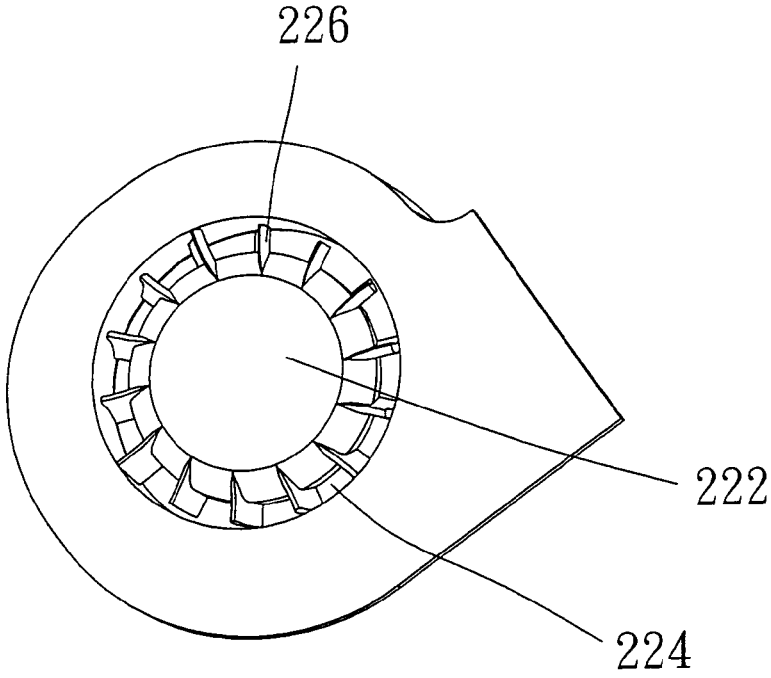

As shown in FIGS. 2A~2C, the plurality of air-guiding elements 225 mounted on the second frame 22 are connected between the support 224 and the sidewall 222 and shaped similar to those of the blades like airfoil structures. In addition, the air-guiding elements 225 can be shaped as strip or plate structures connected between the support 224 and the sidewall 222 as shown in FIG. 3A. Alternatively, the plurality of air-guiding elements 225 are divided into two different parts—some are shaped as strip structures 225*a* connected between the support 224 and the sidewall 222, and others are discontinuous structures 225*b* having two ends respectively connected to the support 224 and the sidewall 222 but having free ends in the center thereof, wherein the strip structures 225*a* and the discontinuous structures 225*b* are alternately or randomly arranged as shown in FIG. 3B. More alternatively, the plurality of air-guiding elements 225 are divided into three different parts 225*a*, 225*b*, 225*c*—the air-guiding elements 225*a* are connected between the support 224 and the sidewall 222; each of the air-guiding elements 225*b* has one end connected to the sidewall 222 and an opposed end thereof is a free end; and each of the air-guiding elements 225*c* has one end connected to the support 224 and an opposed end thereof is a free end, wherein the air-guiding elements 225*a*, 225*b*, 225*c* are alternately arranged as shown in FIG. 3C. In FIG. 3D, the air-guiding elements 225 are connected between the support 224 and the sidewall 222 and have curved shapes with inclined angles.

Figure 4:
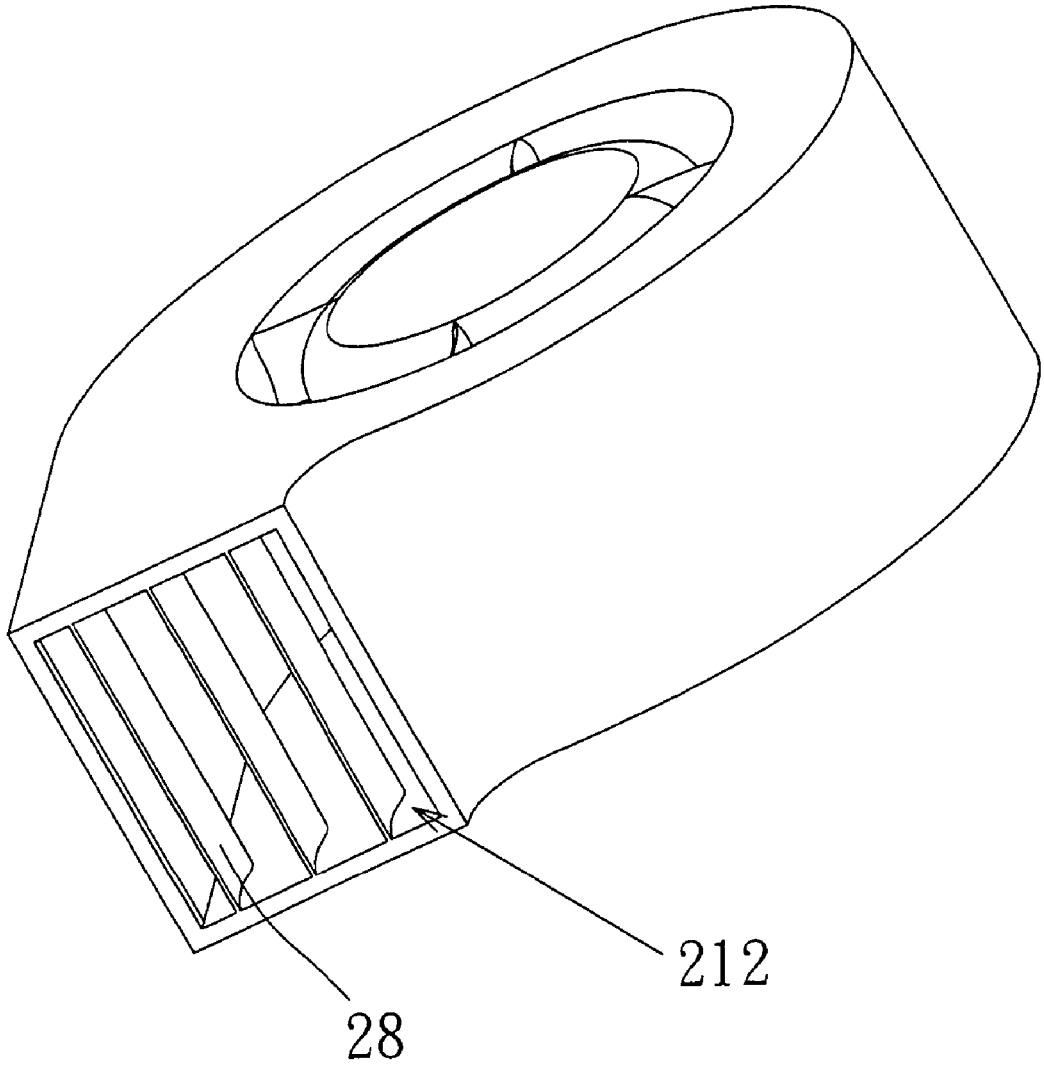
FIG. 4 is a perspective view of a heat-dissipating device according to another embodiment of the present invention.
Figure 5:
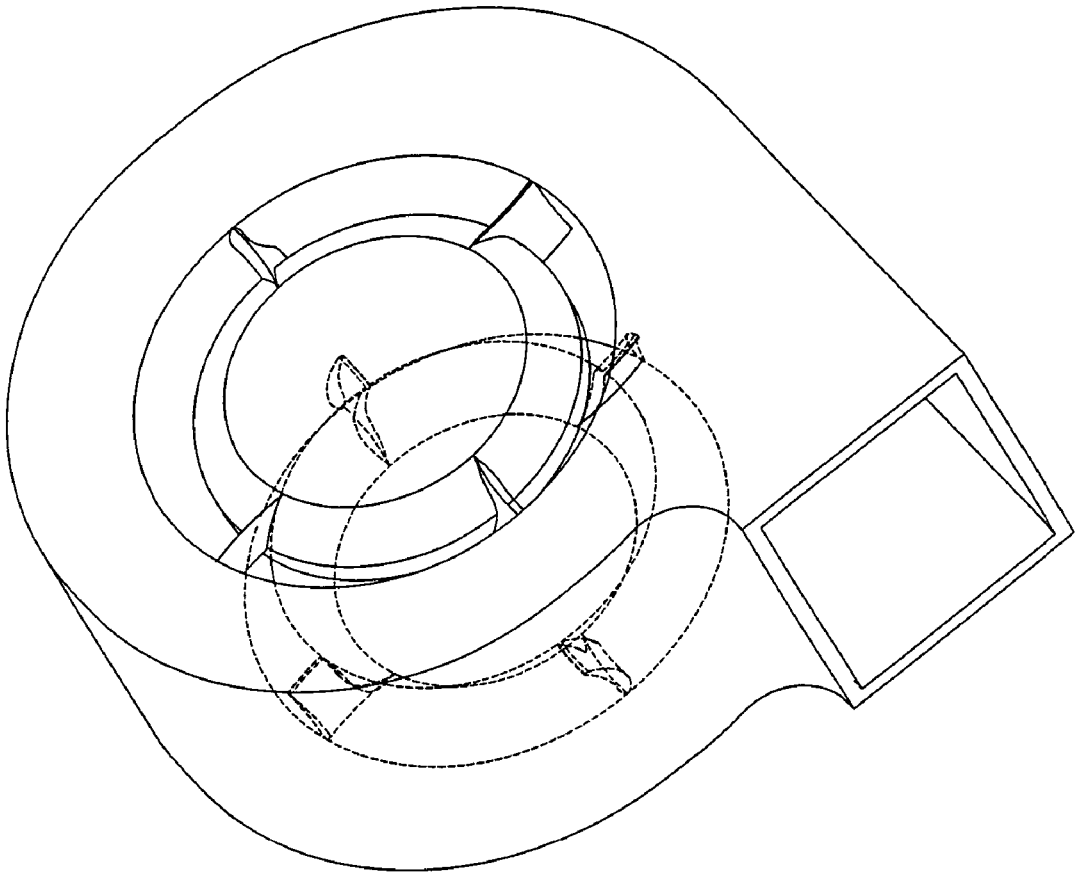
FIG. 5 is a perspective view of a heat-dissipating device according to further another embodiment of the present invention.

The above-described air-guiding elements 225 can be disposed on the air inlet, but another similar air-guiding elements 28 can also be mounted on the air outlet 212 as shown in FIG. 4. The number, shape and arrangement of the air-guiding elements can be modified or selected according to the actual application. In addition, if the aspect of the present invention is applied to an upside-down blower, a two-suction blower or an axial-flow fan, the air-guiding elements 225 can be disposed on one of the air inlets or both, like that shown in FIG. 5.

Figure 1:
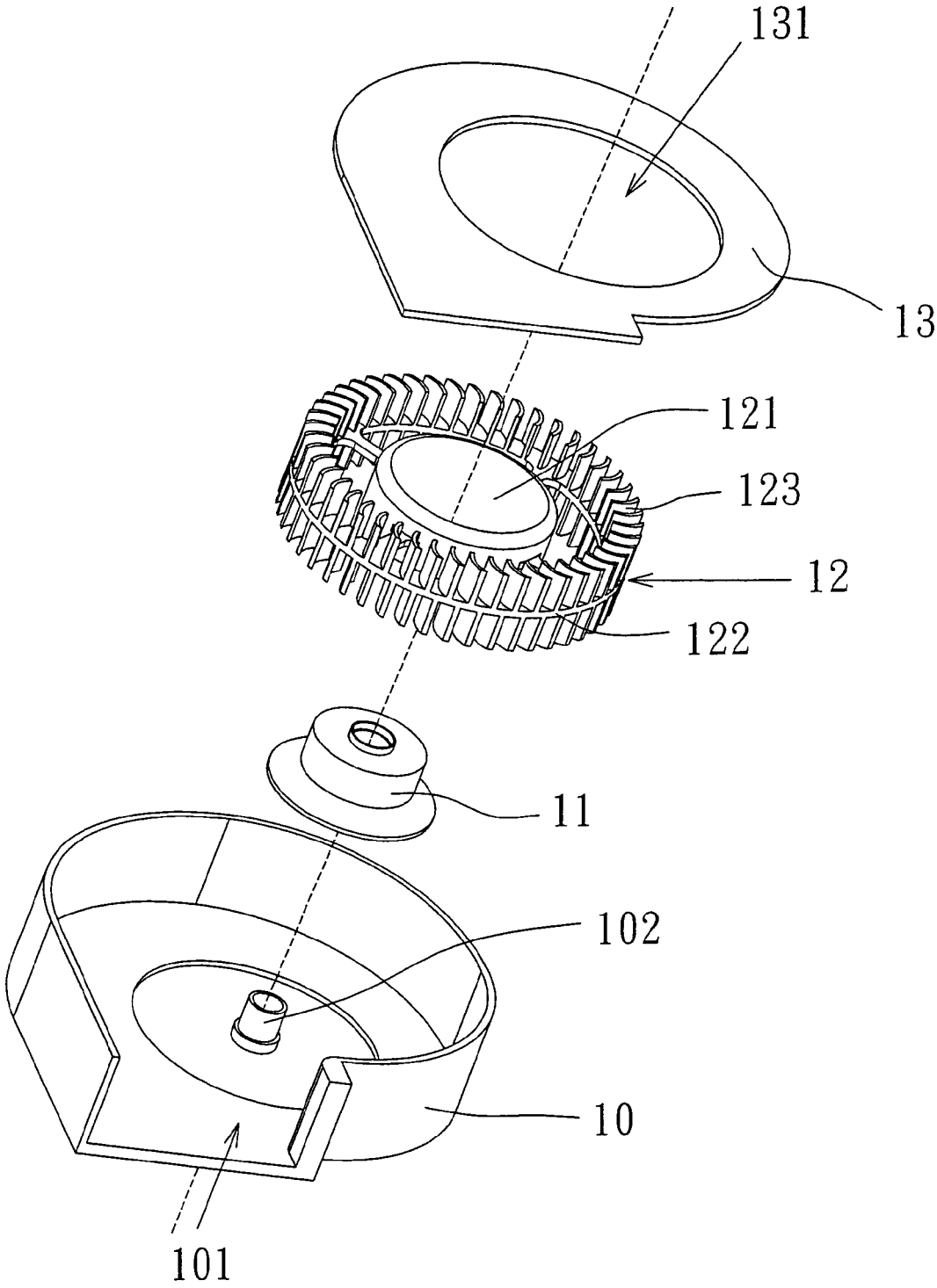
Fig. 1(Prior Art)
FIG. 1 is an exploded view of a conventional blower.
Figure 6:
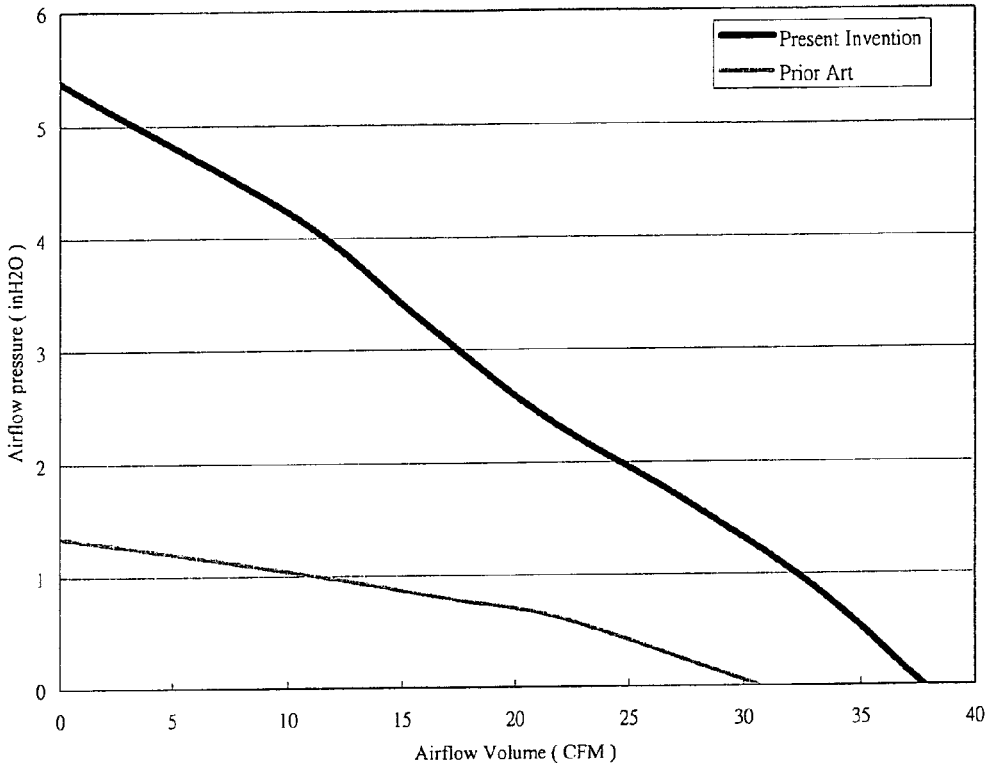
FIG. 6 shows the airflow volume and pressure comparison between the conventional blower of FIG. 1 and the heat-dissipating device of the present invention shown in FIG. 2A.

Finally, please refer to FIG. 6 which shows the comparison of the airflow pressure and volume of the centrifugal fan of the invention shown in FIGS. 2A~2C between those of the conventional blower of FIG. 1. This figure can demonstrate that the airflow pressure and volume of the centrifugal fan of the invention can be greatly increased by the air-guiding elements and the air-gathering chamber.

According to the above description, the present invention utilizes the sidewall and the flange extending from the inner periphery of the air inlet to define an air-gathering chamber or air storage in the housing of the heat-dissipating device to elongate the pressurization of the air passing through the rotor blades so as to prevent the quick change of the air pressure. On the other hand, through the air-guiding elements, the blast pressure can be greatly increased, thereby enhancing its performance and heat-dissipating efficiency.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A heat-dissipating device, comprising:

a housing having at least one opening; and a rotor disposed in the housing and having a first set of blades, wherein the housing has a sidewall extending from the opening, and a plurality of air-guiding members disposed along the sidewall for increasing a blast pressure of airflow passing through the heat-dissipating device;

wherein the sidewall has a flange at one end thereof extending radially to define an entrance of the air-gathering chamber and each of the blades has an end extending toward the entrance of the air-gathering chamber for guiding the airflow into the air-gathering chamber.

2. The heat-dissipating device of claim 1, wherein the housing further comprises:

a first frame provided with a base for supporting the rotor; and a second frame coupled to the first frame and provided with the opening, wherein the sidewall extends from a periphery of the opening inwardly to define an air-gathering chamber in the housing.

3. The heat-dissipating device of claim 2, wherein each of the blades has an end extending toward the entrance of the air-gathering chamber for guiding the airflow into the air-gathering chamber.

4. The heat-dissipating device of claim 2, wherein the air-gathering chamber partially or completely overlaps an air passage through the rotor in height along an axis of the heat-dissipating device.

5. The heat-dissipating device of claim 2, wherein the second frame has an extending part formed in an inner surface thereof and extending inwardly to form an axially compressed airflow passage in the housing.

6. The heat-dissipating device of claim 2, wherein the second frame has a support and the plurality of air-guiding members are arranged between the sidewall and the support.

7. The heat-dissipating device of claim 2, wherein the base of the first frame has a bearing tube formed on the base for allowing a bearing to be disposed therein and the support of the second frame receives an another bearing to support a shaft of the rotor together.

8. The heat-dissipating device of claim 1, wherein the rotor further includes a hub and a base for allowing the blades extending downward from an outer periphery of the hub to a surface of the base.

9. The heat-dissipating device of claim 8, wherein the rotor further includes a second set of blades disposed on the surface of the base and the first and second sets of blades are alternately arranged.

10. The heat-dissipating device of claim 1, wherein a first set of the plurality of air-guiding members is connected between the sidewall and the support and a second set of the plurality of air-guiding members has opposite ends respectively connected to the sidewall and the support, and a discontinuous structure to form free ends.

11. The heat-dissipating device of claim 10, wherein the first and second sets of the plurality of air-guiding members are alternately arranged.

12. The heat-dissipating device of claim 1, wherein a first set of the plurality of air-guiding members is connected between the sidewall and the support, a second set of the plurality of air-guiding members has one end connected to the sidewall and a free end, and a third set of the plurality of air-guiding members has one end connected to the support and a free end.

13. The heat-dissipating device of claim 12, wherein the first, second and third sets of the plurality of air-guiding members are alternately arranged.

14. The heat-dissipating device of claim 1, wherein the plurality of air-guiding members are shaped as strip, plate, curved, inclined or airfoil structures.

15. The heat-dissipating device of claim 1 further comprising another set of air-guiding members mounted on an another opening for discharging or intaking the airflow.

16. A heat-dissipating device, comprising:

a housing having at least one air inlet and an air outlet; and a rotor disposed in the housing and having a first set of blades, wherein the housing has a sidewall extending inward from the air inlet to define an air-gathering chamber in the housing, and a plurality of air-guiding members disposed along the sidewall for increasing a blast pressure of airflow passing through the heat-dissipating device;

wherein the sidewall has a flange at one end thereof extending radially to define an entrance of the air-gathering chamber and each of the blades has an end extending toward the entrance of the air-gathering chamber for guiding the airflow into the air-gathering chamber.

17. The heat-dissipating device of claim 16, wherein a first set of the plurality of air-guiding members is connected between the sidewall and a support positioned on the air inlet and a second set of the plurality of air-guiding members has opposite ends respectively connected to the sidewall and the support, and a discontinuous structure to form free ends.

18. The heat-dissipating device of claim 16, wherein a first set of the plurality of air-guiding members is connected between the sidewall and a support positioned on the air inlet, a second set of the plurality of air-guiding members has one end connected to the sidewall and a free end, and a third set of the plurality of air-guiding members has one end connected to the support and a free end.

19. The heat-dissipating device of claim 16, wherein the plurality of air-guiding members are shaped as strip, plate, curved, inclined or airfoil structures.

20. The heat-dissipating device of claim 16 further comprising another set of air-guiding members mounted on the air outlet.

* * * * *